US005687685A

United States Patent [19]

Amano et al.

[11] Patent Number: 5,687,685

[45] Date of Patent: Nov. 18, 1997

[54] VALVE SEAT AND METHOD

[75] Inventors: Junkichi Amano; Masaaki Yoshikawa, both of Iwata, Japan

[73] Assignee: Yamaha Hatsudoki Kabushiki Kaisha, Iwata, Japan

[21] Appl. No.: 625,941

[22] Filed: Apr. 1, 1996

[30] Foreign Application Priority Data

Mar. 31, 1995 [JP] Japan ..... 7-076624

[51] Int. Cl.[6] ..... F01L 3/22

[52] U.S. Cl. ..... 123/188.8; 123/193.5

[58] Field of Search ..... 123/188.1, 188.8, 123/193.5

[56] References Cited

U.S. PATENT DOCUMENTS 5,492,091 2/1996 Russ ..... 29/888.06

FOREIGN PATENT DOCUMENTS 62-168669 7/1987 Japan .
1186261 7/1989 Japan .
3210961 9/1991 Japan .
5287324 11/1993 Japan .
5332106 12/1993 Japan .
5340299 12/1993 Japan .

*Primary Examiner*—Erick R. Solis
*Attorney, Agent, or Firm*—Knobbe, Martens, Olson & Bear LLP

[57] ABSTRACT

A cylinder head and valve seat arrangement wherein insert rings are metallurgically bonded to the base material of the cylinder head. This permits large valve sizes and multiple valve construction without the likelihood of failures.

12 Claims, 6 Drawing Sheets

VALVE SEAT AND METHOD

BACKGROUND OF THE INVENTION

This invention relates to a cylinder head arrangement and more particularly to an improved valve seat and valve placement arrangement for cylinder heads that permits the use of larger valve areas.

With internal combustion engines, it is particularly known that the performance of the engine can be improved by utilizing multiple valves. It has been found that the breathing capacity of an engine can be substantially increased by using a greater number of valves for performing the same function rather than using a single large valve.

By using a greater number of smaller valves, it is possible to run the engine at higher speeds because the inertial loadings will be lower. In addition, by increasing the number of valves, the combustion camber configuration can at times be optimized. Of course, there is some practical limit to this and certain valve arrangements have been proposed wherein five valves per cylinder heads are employed that utilize three intake valves and two exhaust valves per cylinder.

With the use of more than four valves per cylinder, then it is necessary also to mount the valves in such a way that not only can they enjoy maximum lift, but also so that the combustion chamber volume and surface area may be maintained small. This facilitates the maintenance of high compression ratios and low quenching which are necessary to improve the performance of the engine. There are, however, certain additional practical aspects which limit the number of valves that can be employed and specifically the distance which must be maintained between the valves. This factor deals at least in part with the way in which the cylinder head and valve seats are formed.

In internal combustion engines, it frequently is the practice to employ aluminum or aluminum alloys as the material for a number of the major engine castings such as the cylinder heads. When the cylinder heads are formed from aluminum or aluminum alloys, however, certain components of the cylinder head are formed from a dissimilar material so as to improve performance. For example, the valve seats of the cylinder head are normally formed from a harder, less heat conductive material such as iron or ferrous iron alloys. By utilizing such harder materials, the valve seat life can be extended. However, the attachment of the dissimilar valve seat insert into the cylinder head presents a number of problems.

Conventionally, it has been the practice to form the cylinder head passages with recesses adjacent the seating area into which the insert rings which form the valve seat are press fit. The use of press fitting has a number of disadvantages. First, it requires relatively large valve seat inserts in order to withstand the pressing pressures. In addition, the press fit must be such that the insert ring will not fall out when the engine is running. As a result, there are quite high stresses exerted both on the cylinder head and on the insert ring. The stresses can result in loads which may eventually cause cracks in the cylinder head.

These types of construction also limit the maximum size and spacing of the valve seats in order to ensure adequate cylinder head material between adjacent valve seats to reduce the likelihood of cracking. In addition, the large seat inserts compromise the configuration of the intake passages, particularly at the critical valve seating area. Finally, these constructions result in somewhat poor heat transfer from the valve to the cylinder head due to the poor thermal conductivity of the valve seat material and its connection to the remainder of the cylinder head.

In addition, the interface between the insert ring and the cylinder head frequently leaves voids or air gaps which further reduce the heat transfer and thus cause the valves to run at a higher temperature. This higher temperature operation of the valves requires the valves to be made heavier and stronger and thus reduces the performance of the engine and increase its size and cost.

With the previously proposed practice of utilizing pressed in valve seat inserts, the resulting insert is machined so as to form the valve seating surface against which the poppet valve acts so as to provide the flow control. For a variety of reasons, and particularly to avoid masking of the intake valve, the large inserts previously employed have been machined so that the valve seating surface is disposed substantially radially inwardly form the outer periphery of the insert. That is, it has been the practice to maintain a fairly large thickness of insert ring material around the actual valve seating surface. This further reduces the size of the flow passages provided.

Furthermore, the machining of these seating surfaces is rather more difficult with the prior art type of constructions. In addition, in order to maintain the ability to machine the valve seats and specifically the valve seating surfaces of the insert ring, it has been necessary to provide a configuration around the head of the valve when the valve is in its closed position that may somewhat shroud the valve and which will reduce the initial air flow areas upon opening of the valve. Furthermore, it is more difficult to provide the desired configuration in the adjacent cylinder head material so as to provide the desired flow path between the combustion chamber recess and the respective passage in the cylinder head.

It is, therefore, a principal object of this invention to provide an improved cylinder head and valve seat arrangement for a reciprocating engine.

It is a further object of this invention to provide an improved cylinder head and valve seat arrangement that permits the use of large valve flow areas and close positioning of the valves to each other so as to maximize the potential flow area.

It is a still further object of this invention to provide an improved cylinder head arrangement that permits the use of three intake valves per cylinder while maximizing valve diameter and permitting the valve seats to be positioned quite close to each other.

SUMMARY OF THE INVENTION

A first feature of this invention is adapted to be embodied in a cylinder head assembly comprising a main body formed from a first material and defining a recess that is adapted to cooperate with an associated cylinder bore and piston for forming a combustion chamber. At least one flow passage extends through the cylinder head from the recess. A valve seat is formed at the recess end of this passage by an insert ring formed from a material dissimilar from the first material of the cylinder head and which is metallurgically bonded thereto. The insert ring has an inclined seating surface that is adapted to be engaged by a poppet valve for controlling the flow through the passage. The seating surface formed in the insert ring terminates at its outer periphery adjacent the outer peripheral edge of the insert ring so that the entire surface of the insert ring from its outer periphery to the passage is engaged by the poppet valve.

Another feature of the invention is adapted to be embodied also in a cylinder head assembly for an internal combustion engine. The cylinder head assembly includes a main cylinder head member formed from a first material. This cylinder head member defines at least one recess that is adapted to cooperate with a cylinder head bore and associated piston for forming a combustion chamber for the engine. A pair of flow passages are formed in the cylinder head and terminate at one end in the recess. A pair of insert rings formed from a material dissimilar to the first material are metallurgically bonded to the first material and form valve seats on the recess end of the passages. Each insert ring is formed with a seating surface that is adapted to be engaged by a respective poppet valve for controlling the flow through the respective passages. The distance between adjacent peripheral edges of the poppet valves is not substantially less than the distance between the peripheral edges of the insert ring seating surfaces.

PRIOR ART CONSTRUCTION

Figure 1:
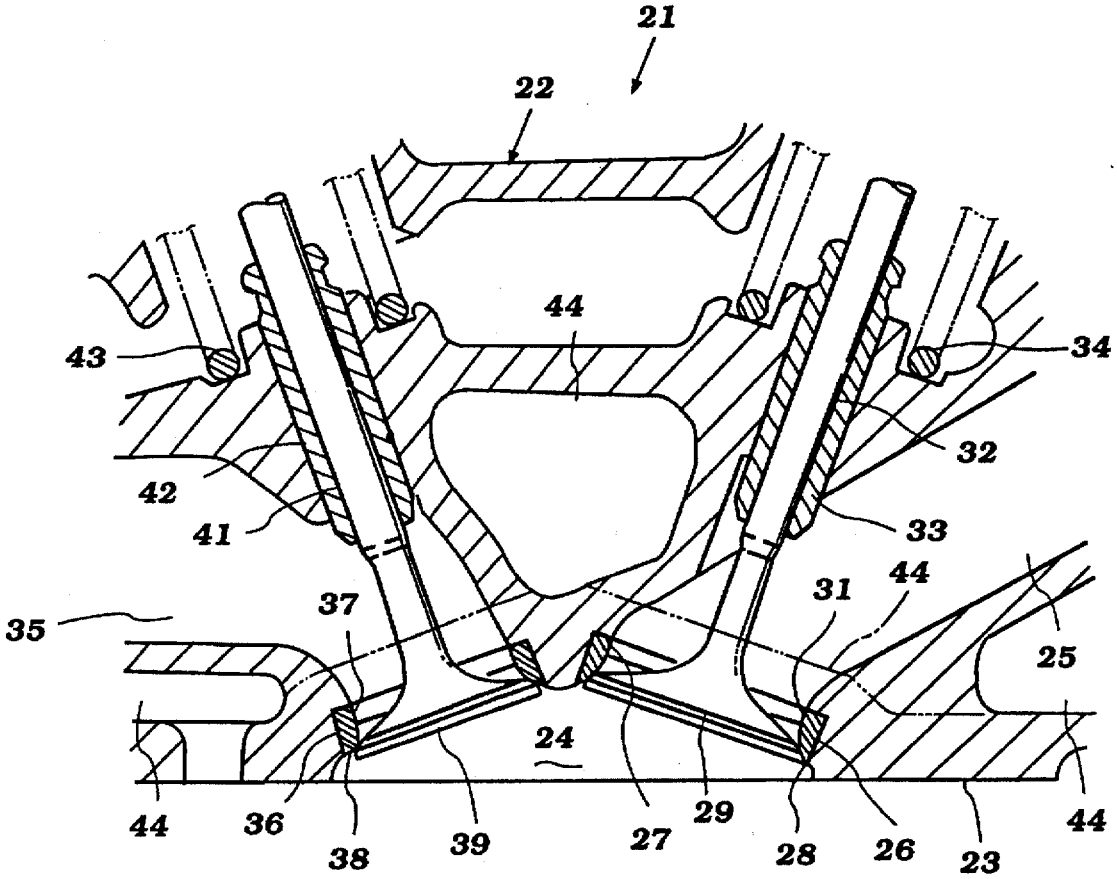
Figure 1 Prior Art
FIG. 1 is an enlarged cross-sectional view taken through a portion of a cylinder head of an internal combustion engine having a valve seat arrangement made by a conventional process and apparatus.

FIG. 1 is a cross-sectional view taken through a portion of a cylinder head, indicated generally by the reference numeral 21, of an engine constructed in accordance with a prior art type of practice. The cylinder head 21 is comprised of a main cast body, indicated generally by the reference numeral 22, that is formed preferably from a light weight, highly heat conductive material such as aluminum or an aluminum alloy. The cylinder head member 22 has a lower surface 23 that is adapted to be held in sealing engagement with an associated cylinder block (not shown) in a well known manner.

The cylinder head sealing surface 23 surrounds a plurality of recesses 24, one for each cylinder bore of the associated cylinder block. The recesses 24 cooperate with the associated cylinder bore and piston reciprocating therein to form the combustion chambers of the engine. A portion of the sealing surface 23 may also be in confronting relationship with the cylinder bore if a squish action is required. Since the general configuration of the combustion chamber forms no part of the invention, except for the valve positioning and placement therein, neither the prior art nor the preferred embodiments will deal with the details of the shape of the combustion chamber. It will be readily apparent to those skilled in the art how the invention may be utilized with any of a wide variety of types and shapes of combustion chambers.

In the illustrated prior art type of construction, the engine is two- or four-valve per cylinder engine. This includes either one or two intake passages 25 which are formed in the main cylinder head casting 22 and which end in valve seats that are formed by insert rings, indicated generally by the reference numeral 26. These insert rings 26 form flow passages 27 that are complementary to and which form the termination of the intake passages 25.

The insert rings 26 are also formed with valve seating surfaces 28 which are valved by intake valves of the poppet type, indicated at 29. In order to place the insert rings 26 in place in the convention practice, a press fitting technique is employed. To practice this, the cylinder head body 22 at the valve seating area is provided with bored recesses 31 that have diameter which is slightly smaller than the outer diameter of the insert rings 26 to assure a press fit. Then, either the cylinder head body 22 is heated and/or the insert rings 26 are chilled so as to establish a closer fit so that the insert rings 26 can be pressed into place. When the material return to their normal temperatures, the insert rings 26 will be then tightly held in place. There are several problems with this type of construction, as is noted in the preamble of this application and which will, therefore, not be repeated.

The intake valves 29 have their stem portions 32 slidably supported in guides 33 that are also pressed or cast in place in the cylinder head body 22. These valves are urged to their closed position by means of coil compression springs 34 which act against keeper retainer assemblies (not shown) for holding the intake valve 29 in their closed position. The intake valves 29 are opened by any suitable valve actuating mechanism known in the art.

On the side of the cylinder head body 22 opposite the intake passages 25, there are formed one or more exhaust passages 35. These exhaust passages 35 have, in the cylinder head recess 24, valve seats formed by insert rings 36. These insert rings 36, like the intake insert rings 26 are formed from a suitable material such as a Sintered iron or the like. They also have passages 37 that are complementary to the exhaust passages 36 and seating areas 38 that are valved by poppet type exhaust valves 39.

The exhaust valves 39 are also mounted with their stems 41 slidably supported in the valve guides 42. Coil compression springs 43 urges the exhaust valves 39 to their closed position. Like the intake valves 29, the exhaust valves 39 are operated by any suitable mechanism.

The described embodiment employs a water cooling system that consists of a water jacket 44 which extends generally around the intake and exhaust passages for providing cooling. It will be seen that, because of the use of the large insert rings 26 and 36, the cooling jacket 44 is spaced some distance away from the respective valve seat insert rings 26 and 36 and, hence, the cooling of the poppet valves 29 and 39 is not as good as desired.

DETAILED DESCRIPTION OF THE PREFERRED EMBODIMENTS OF THE INVENTION

Figure 2:
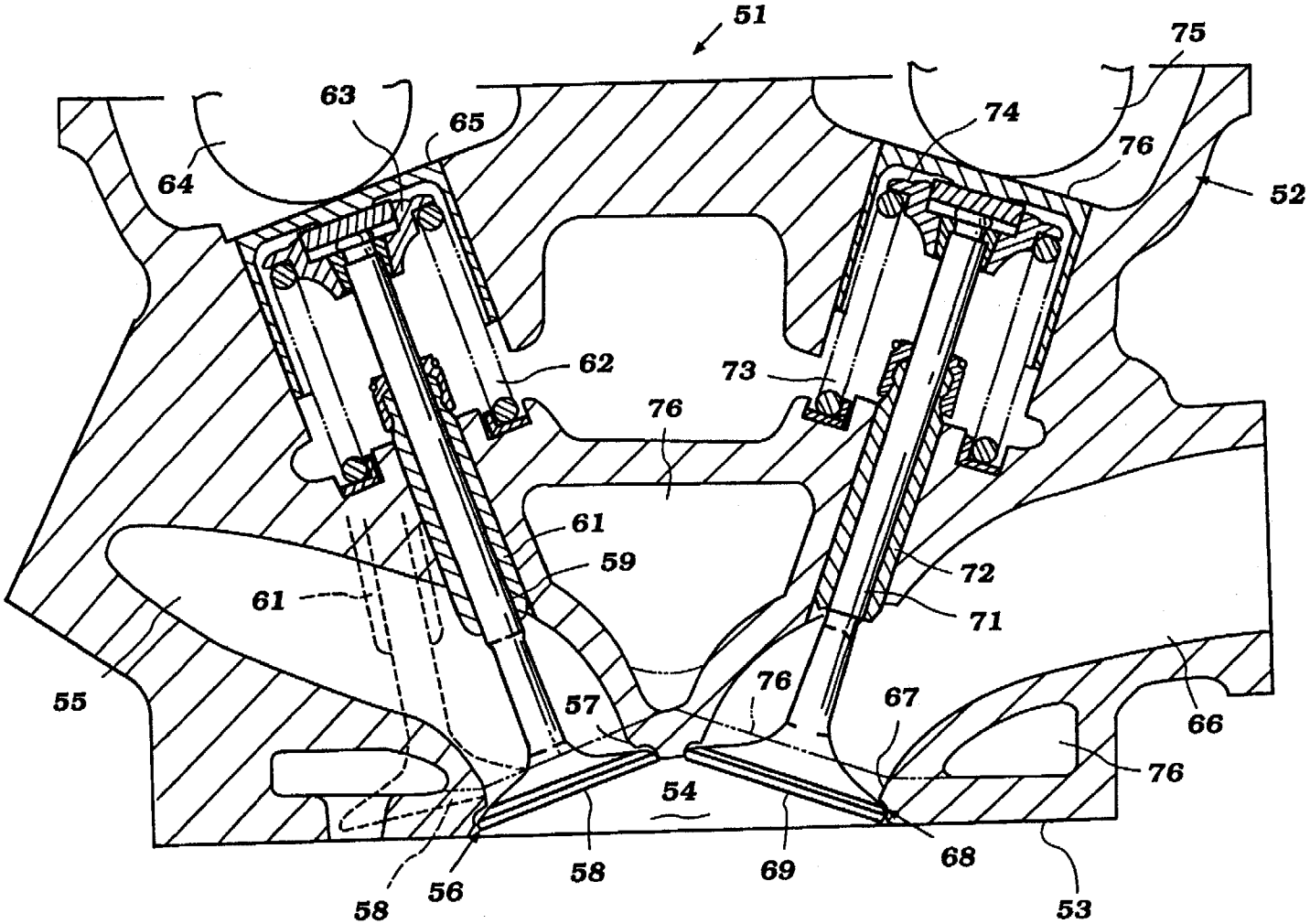
FIG. 2 is an enlarged cross-sectional view, in part similar to FIG. 1, and shows the corresponding construction of an engine cylinder head having a valve seat arrangement constructed and manufactured in accordance with an embodiment of the invention.

FIG. 2 is a cross-sectional view, in part similar to FIG. 1, and shows a cylinder head assembly, indicated generally by the reference numeral 51, which includes a valve seat arrangement that is constructed and manufactured in accordance with an embodiment of the invention. The engine embodying the cylinder head assembly 51 is of the five valve per cylinder type. This utilizes, as will be described, three intake valves per cylinder and two exhaust valves per cylinder. Thus, the size of the intake valves in this engine are smaller than the size of the exhaust valves, but the total intake flow area is greater. For this reason, the intake and exhaust sides of the engine are reversed in FIG. 2 from FIG. 1 so as to permit a better comparison with the prior art construction between adjacent intake and exhaust valves and their relationship to the cylinder head.

Referring now in detail particularly to FIG. 2, the cylinder head 51, like the prior art type of constructions, is comprised of a main cylinder head casting 52 that is formed from a light weight material such as aluminum or an aluminum alloy. The cylinder head casting 52 has a lower surface 53 that is adapted to be fixed in sealing relationship with an associated cylinder block (not shown) in any known manner. The surface 53 is interrupted by recesses 54 which cooperate with the cylinder bores and pistons to form the combustion chambers of the engine. As previously noted, the configuration of the combustion chamber and recess 54 per se can be of any known type.

A Siamesed type intake passage 55 is formed in the cylinder head casting 52 and extends from a common inlet in an outer surface of the cylinder head member 52 to three individual valve seats formed from a respective insert ring 56, as will be described. These insert rings 56 are metallurgically bonded the casting material of the cylinder head body 52 in a manner which will also be described. The cylinder head intake passage 55 is bifurcated and have 3 sections 57 which extend so each of these valve seats 56.

In accordance with a preferred orientation for the valve seats 56 and their associated poppet valves which control them, which poppet valves are indicated generally by the reference numeral 58, the configuration may be as described in one or more of the embodiments as shown in U.S. Reissue Pat. No. RE 33787 which was reissued on Jan. 7, 1992 and which is based upon original U.S. Pat. No. 4,660,529 issued Apr. 28, 1987, both assigned to the assignee hereof.

Although reference may be had to that reissue patent and its original patent for the construction and orientation of the valve seats 56 and their associated poppet type intake valves 58, the general configuration is that there are two side intake valve seats which are disposed closer to a plane containing the axis of the cylinder bore with which the cylinder head 51 is associated and also containing the axis of rotation of the crankshaft of the engine. In fact, the valve seats 56 may slightly extend over this plane. The remaining valve seat 56 and poppet type intake valve 58 is disposed further from this plane and generally between the side intake valve and is comprised of a center intake valve and valve seat.

Each of the intake valves 58 has its stem portion 59 slidably supported in a respective valve guide 61 that is pressed or cast in place in the cylinder head body 52. Coil compression springs 62 act against keeper retainer assembly 63 for urging the intake valves 58 to their closed position. The intake valves 58 are opened by respective lobes of an intake camshaft 64 via thimble tappets 65 in a manner well known in this art.

A pair of exhaust passages 66 extends through the cylinder body 52 from the recesses 54 for cooperation with an associated exhaust manifold (not shown) for discharging the exhaust gases to the atmosphere. These exhaust passages 66 extend from portions 67 in which exhaust valve seats formed by insert rings 68 are positioned in a manner which will also be described and similar to that manner utilized with the intake valve seat insert rings 56.

Poppet type exhaust valves 69 have stem portions 71 that are slidably supported in valve guides 72 pressed or cast into the cylinder head body 52. These poppet valves 69 cooperate with the valve seat 68 for controlling the opening and closing of the exhaust passages 66.

Coil compression springs 73 bear against the cylinder head body 52 and against keeper retainer assembly 74 affixed to the stem 71 of the exhaust valve 69 for urging them to their closed position. The exhaust valves 69 are opened by the lobes of an exhaust camshaft 75 via thimble tappets 76 in a well known manner.

Like the prior art constructions, the cylinder head 51 is provided with a cooling jacket 76 for water cooling of the engine. However, unlike the prior art type of constructions, the way in which the valve inserts 56 are formed and bonded in place permits the cooling jacket 76 to be disposed much closer to the valve seats 56 and the heads of the intake and exhaust valves 58 and 69, respectively. As a result, much lower valve temperatures can be enjoyed. This permits the formation of the head of the valves to be lighter and, thus, the engine can run at a higher speed without damage and obtain a better performance.

Figure 3:
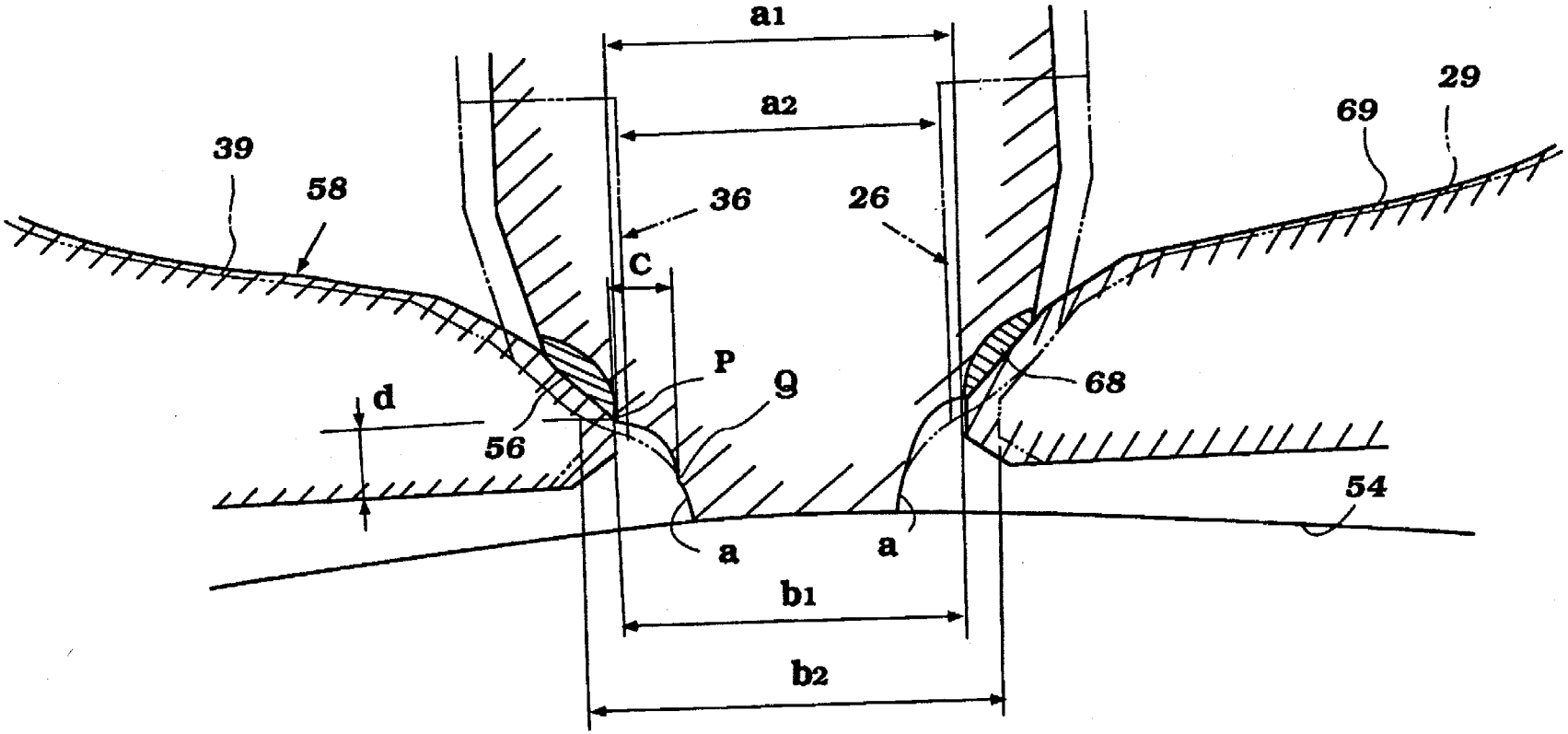
FIG. 3 is a yet further enlarged cross-sectional view taken through the area between adjacent valves and showing the comparison between the construction in accordance with this invention, in solid lines and that of the prior art, in phantom lines.

The structure by which these results are obtained may be best understood by reference to FIG. 3 which is an enlarged view of the area of the cylinder head between adjacent intake and exhaust valves and specifically between one of the side intake valves and the exhaust valve in accordance with this embodiment as shown in FIG. 2. The inventive construction is shown in solid lines in FIG. 3 and the prior art type of construction is shown in phantom lines. As has been noted, the intake and exhaust valves are on opposite sides from each other in FIG. 2 from those of FIG. 1. As noted the size of the intake valves and exhaust valves of FIG. 1 is the same as the exhaust and intake valves of FIG. 2 so the comparison can be made in FIG. 3 for the reasons already noted.

As may be seen in FIG. 3, a distance $a_2$ must be allowed between the inner periphery of adjacent bores formed in the prior art cylinder head material so as to accommodate the insert rings 26 and 36 for the pressed fitting thereof. In addition, since the valve seating surfaces on the prior art insert rings are formed so that they extend at a substantial distance inwardly from their outer peripheral edges, the spacing between the heads of the intake and exhaust valves 29 and 39 is a distance $b_2$. Furthermore, the cylinder head cast surfaces on the periphery of the valve seat recesses, which surfaces are indicated at "a" extend with a substantially constant radius up to the insert rings as shown in the phantom line view. As a result, when the valves 29 and 39 initially open, there will be a substantially masking effect on them.

These disadvantages are clearly avoided with the inventive construction as shown in FIG. 2, as may also be understood by reference to FIG. 3. It will be seen that a distance $a_1$ between the inner peripheral edges of the finished insert rings 56 is greater than the distance $a_2$. Thus, even though the stresses are less because of the method of inserting the insert rings 56 in the prior art pressing methods, it is still possible physically to provide even greater metal spacing between them. Thus, in a practical engine having the same stresses as the prior art, the valve seats can be placed much closer to each other and, thus, permit greater flow openings.

Also, it should be noted that the contact between the valves 58 and 69 and their respective seats 56 and 68 is at the outer peripheral edges of the insert rings 56 and 58 rather than inwardly from them. As a result, the total area of the insert rings 56 and 68 can be substantially less than the prior art constructions. Furthermore the heat transfer can be substantially increased. This results in cooler valve temperatures and reduced valve stress. Thus lighter valves may be employed.

In addition, instead of continuing the sharp curvature a of the base cylinder head material, it is possible at the point Q to continue on and provide a deeper recess up to the point P at the peripheral edge of contact of the valves 58 and 69 with the insert rings 56 and 68. Hence, there is substantially less shrouding of the valves and better flow will occur. This area extends over the distance c as seen in the figure. The distance c is less than the height d or the valve lower face from the seating point p.

It should be noted that the spacing between the heads of the valves 56 and 69 $b_1$ is substantially less than the prior art constructions and the dimension of $a_1$ is greater than or equal to the distance $b_1$. This is quite different from the prior art construction where the distance $a_2$ is substantially less than the distance $b_2$. This means that, even if the same spacing between the insert rings is maintained, the valve spacing and valve diameter must be substantially smaller. Also, even though in a preferred embodiment $a_1$ is greater than or equal to $b_1$, $a_1$ may be slightly less than $b_1$.

It should also be noted that, with this construction, the depth of the valve head below the peripheral edge of the seating surface d extends into the combustion chamber at the same distance for the inventive construction and the prior art construction. Therefore, the combustion chamber design is not adversely affected by this configuration.

The method and structure by which the valve seat insert rings 56 and 68 are formed and bonded in place will now be described by particular reference to FIGS. 4–11. It should be noted that this methodology and the construction and formation of the insert rings may be as described in co-pending application entitled "Valve Seat-Bonded Cylinder Head and Method for Producing Same," Ser. No. 08/483,246 filed Jun. 7, 1995. In addition, some of the technology employed is also described in co-pending application entitled "Valve Seat," Ser. No. 08/278,026 filed Jul. 20, 1994. Furthermore, the insert rings may be constructed and arranged and heat treated as described in the co-pending application entitled "Valve Seat," Ser. No. 08/614,503, filed Mar. 13, 1995 (Attorney Docket No. YAMAH3.430A). The disclosures of those applications are all incorporated herein by reference. Although those disclosures are incorporated herein by reference, the technique will be described in some detail herein. However, reference should be had to those co-pending applications for full details of the preferred methodology for forming the insert rings.

The construction will be described in connection with the bonding in place of one of the intake insert rings 56, but it should be understood that the same technique is employed in conjunction with the exhaust insert rings 68. Referring now to these figures, the insert ring 58 in accordance with this embodiment is formed with a cylindrical inner surface 81 that is relatively short in axial length and which merges into a tapered conical surface 82 which is disposed an acute angle to the axis of the surface 81 and which extends for a substantially length.

The surface 82, which is actually the pressing surface, as will be described, ends in an end surface 83. And a first, conical outer surface section 84 extends at an acute angle to the axis of the cylindrical section 81 and merges at a rounded section 85 into an inclined lower end surface 86. This angle is at an acute angle to a plane perpendicular to the axis of the cylindrical section 81.

Figure 4:
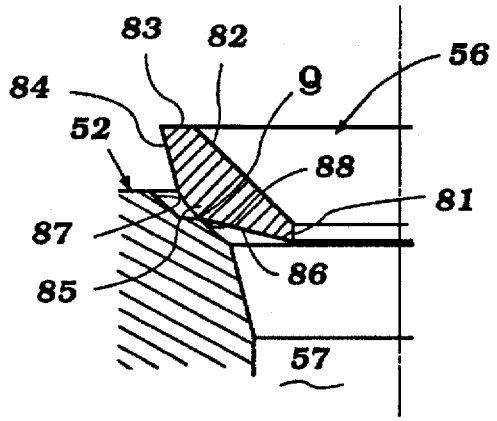
FIGS. 4–9 are still further enlarged cross-sectional views showing the sequence of forming the valve seating surface and valve seat in accordance with an embodiment of the invention.
Figure 5:
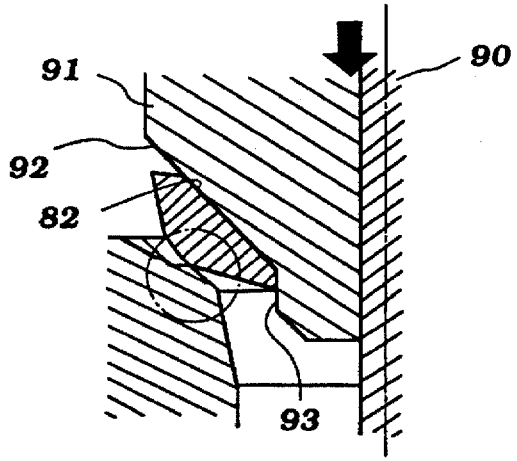
Figure 6:
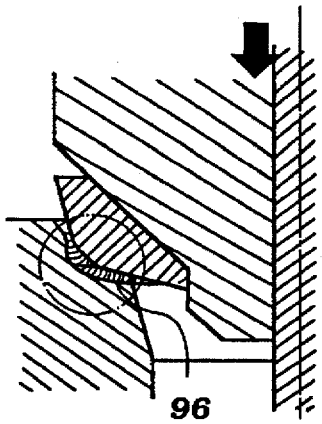
Figure 7:
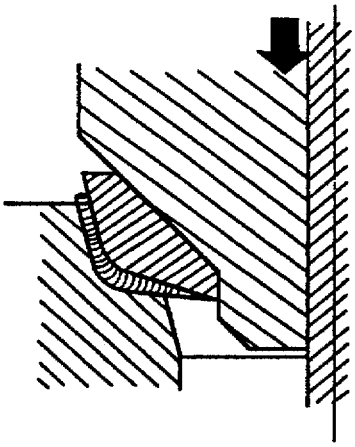
Figure 10:
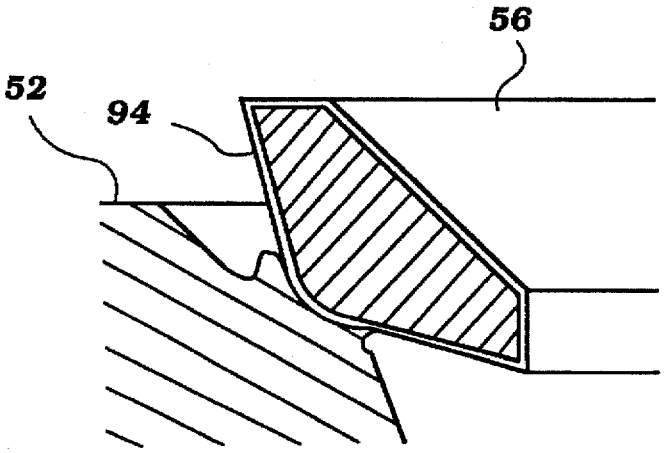
FIG. 10 is a yet further enlarged cross-sectional view showing the state between that of FIGS. 5 and 6 to illustrate how the bonding method forms an improved metallurgical construction.
Figure 11:
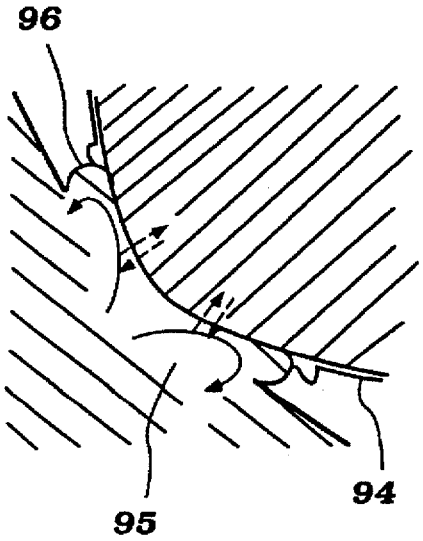
FIG. 11 is a still further enlarged cross-sectional view showing the same construction in FIG. 10, but further illustrating how the metallurgical strength is improved in accordance with this method and how impurities can be expelled during the bonding process.

The cylinder head material 52 is formed with a recess that is comprised of a first section 87 that is connected to a second section 88 that are joined by a horizontal surface that forms a projecting ledge 89 that contacts the rounded portion 85 of the insert ring 43 upon initial installation (FIGS. 4, 5 and 10). This tends to form a localized area that will begin the plastic deformation phase.

The pressing apparatus includes a guide post 90 that extends into the cylinder head passage opening 57 and which supports a pressing member 91. The pressing member 91 has an inclined pressing surface 92 that is complementary in configuration to the insert conical portion 82. A pilot portion 93 of the pressing member is generally complementary to the insert ring opening 81, but actually forms no pressing function.

The insert ring 56 is formed preferably from a material, as described in depending application Ser. No. 08/614,503 (YAMAH3.430A), and one which has an alloying and heat treatment so that is elongation at rupture is one percent (1%) or more. This is opposed to the conventional Sintered iron elongation at rupture of zero, point two percent (0.2%). Because of this greater elongation, the pressing forces will not cause any stresses in the insert ring 56 that can cause cracks, either on pressing or subsequently.

A pressing force is then applied, and a current is passed so as to cause the plastic deformation layer 94 to be formed. This pressing pattern is as described by particular reference to FIG. 15 of co-pending application Ser. No. 08/614,503 (YAMAH3.430A).

A pressure is gradually applied through the pressing mandrel or tool 91 along its surface 92. This pressure is gradually built up to a first pressure and is held constant for a time until the electrical current begins to flow. The electrical current is built up over a time period to a first relatively high current flow. After this occurs, there will be sufficient liquification and plastic deformation of the material, and the pressing force is then built up to a higher second pressing force.

At some time, the current is decreased so as to avoid excess heating and any melting or plastic deformation of the insert ring 56. Then the current flow is again raised to a lower level from the level and held at this lower level for an additional time period while the pressing force is maintained. Then the current flow is discontinued while the pressing continues up to the stage when the bond is finally and completely formed.

This technique provides a metallurgical bond rather than a weld. Hence there is little or no alloying of the materials of the cylinder head and insert ring. This leaves no voids and significantly improves heat transfer. Also the material of the cylinder head body 52 is work hardened adjacent the insert ring 56 to further increase strength and reduce cracking.

The resulting metallurgical bond is preferably no more than 10 μ in thickness. A plastically deformed layer, which is about 200 μ from the actual interface is comprised of dendrite crystals and columnar crystals, which are typically in the cast texture, that are curved. Thus, the aspect ratio of eutectic silicon particles is great, and dislocation density is high due to the dislocation caused by deformation. Hence, hardness is raised, also, due to the work hardening. However, it should be noted that the chemical constituents of the plastically deformed layer are substantially identical to that in the base material. This is true up to the depth 10 μ at the interface where there is a metallurgical bond between the materials. Because of this, even when the engine is running and the valve seat area becomes heated, there will be no subsequent alloying that could cause failures.

Figure 8:
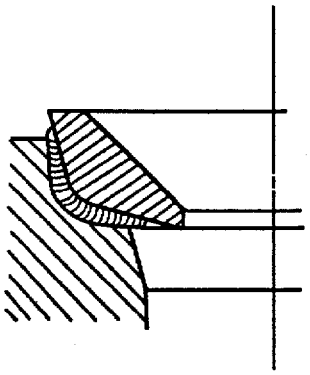
Figure 9:
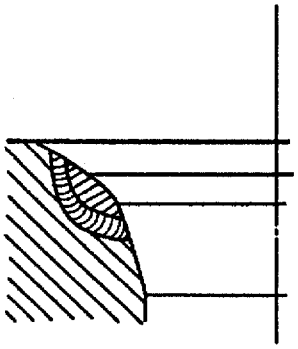

As is noted in a number of the aforementioned co-pending applications and as best seen in FIG. 10, the insert ring 56 may preferably be coated with a coating of a reactive material such as copper or the like, indicated by the reference numeral 94. During the initial phase of the plastic deformation as shown in FIG. 10, this coating cooperates and coacts with the plastic aluminum material of the cylinder head body 52 and will react with any oxidation coatings therein to cause them to be expelled in the direction of the arrows 95 in FIG. 11 away from the bonded area and toward the outer periphery of the resulting bond, as best seen in FIG. 8. Thus, upon subsequent machining as shown in FIG. 9, these surface imperfections will be removed and further improve the strength of the bond between the insert ring 56 and the base cylinder head material 52.

Thus, from the described construction, it should be readily apparent that this construction permits the use of large valve areas and permits the valve heads to be positioned quite close to each other without raising the damage of surface cracking or subsequent failures in the cylinder head.

Once the bonding is completed, as seen in FIG. 8, the final machining is performed. FIG. 9 shows the final machined valve seat. The plastically deformed, work hardened layer is indicated at 96.

Of course, the foregoing description is that of a preferred embodiment of the invention, and various changes and modifications may be made without departing from the spirit and scope of the invention, as defined by the appended claims.

What is claimed is:

1. A cylinder head assembly comprising a main body formed from a first material and defining a recess adapted to cooperate with an associated cylinder bore and piston for forming a combustion chamber, at least one flow passage extending through said main body from said recess, and a valve seat formed at the recess end of said passage by an insert ring formed from a material dissimilar from said first material and metallurgically bonded thereto by applying sufficient pressure and heat to said insert ring and said main body to plastically deform said main body without effecting melting and alloying of said materials, said insert ring having an inclined seating surface adapted to be engaged by a poppet valve for controlling the flow through said passage, said seating surface terminating at its outer periphery adjacent the outer peripheral edge of said insert ring so that the entire surface of said insert ring from its outer periphery to the passage is engaged by the poppet valve.

2. A cylinder head assembly as set forth in claim 1 wherein the metallurgical bond is no greater in thickness than about 0.10 μ.

3. A cylinder head assembly as set forth in claim 1 wherein first material is work hardened adjacent the insert ring.

4. A cylinder head assembly as set forth in claim 1 wherein the metallurgical bond is no greater in thickness than about 0.10 μ.

5. A cylinder head assembly for an internal combustion engine comprising a main cylinder head member formed from a first material, said cylinder head member defining at least one recess that is adapted to cooperate with a cylinder head bore and associated piston for forming a combustion chamber for the engine, a pair of flow passages formed in said main cylinder head member and terminating at one end in said recess, a pair of insert rings formed from a material dissimilar to said first material metallurgically bonded to the first material by applying sufficient pressure and heat to said insert rings and said main body to plastically deform said main body without effecting melting and alloying of said materials and forming valve seats on the recess end of said passages, each insert ring being formed with a seating surface that is adapted to be engaged by a respective poppet valve for controlling the flow through the respective passage, the distance between adjacent peripheral edges of the poppet valves is not substantially less than the distance between the peripheral edges of said insert ring seating surfaces.

6. A cylinder head assembly as set forth in claim 5 wherein the distance between the peripheral edges of the insert rings is not substantially greater than the distance between adjacent peripheral edges of the poppet valves.

7. A cylinder head assembly as set forth in claim 6 wherein the distance between the peripheral edges of the insert rings is equal to or greater than the distance between adjacent peripheral edges of the poppet valves.

8. A cylinder head assembly as set forth in claim 5 wherein the metallurgical bond is no greater in thickness than about 0.10 μ.

9. A cylinder head assembly as set forth in claim 5 wherein first material is work hardened adjacent the insert ring.

10. A cylinder head assembly as set forth in claim 9 wherein the metallurgical bond is no greater in thickness than about 0.10 μ.

11. A cylinder head assembly as set forth in claim 10 wherein the distance between the peripheral edges of the insert rings is not substantially greater than the distance between adjacent peripheral edges of the poppet valves.

12. A cylinder head assembly as set forth in claim 11 wherein the distance between the peripheral edges of the insert rings is equal to or greater than the distance between adjacent peripheral edges of the poppet valves.

* * * * *